US012129069B2

(12) United States Patent
Rapparini et al.

(10) Patent No.: US 12,129,069 B2
(45) Date of Patent: Oct. 29, 2024

(54) SYSTEM AND METHOD FOR PRODUCING PACKAGES PROVIDED WITH A REVERSIBLE CLOSING SYSTEM

(71) Applicant: ICA S.P.A., Bologna (IT)

(72) Inventors: Gino Rapparini, Bologna (IT); Maurizio Generali, Bologna (IT)

(73) Assignee: ICA S.P.A., Bologna (IT)

( * ) Notice: Subject to any disclaimer, the term of this patent is extended or adjusted under 35 U.S.C. 154(b) by 106 days.

(21) Appl. No.: 17/778,670

(22) PCT Filed: Nov. 24, 2020

(86) PCT No.: PCT/IB2020/061080

§ 371 (c)(1),
(2) Date: May 20, 2022

(87) PCT Pub. No.: WO2021/105868

PCT Pub. Date: Jun. 3, 2021

(65) Prior Publication Data

US 2023/0002097 A1 Jan. 5, 2023

(30) Foreign Application Priority Data

Nov. 28, 2019 (IT) ..... 102019000022362

(51) Int. Cl.

| | |
|---|---|
| ***B65B 61/18*** | (2006.01) |
| ***B65B 9/213*** | (2012.01) |
| *B65D 75/58* | (2006.01) |

(52) U.S. Cl.

CPC ..... *B65B 61/186* (2013.01); *B65B 9/213* (2013.01); *B65D 75/5877* (2013.01)

(58) Field of Classification Search

CPC .... B65B 9/213; B65B 61/186; B65D 75/5877
See application file for complete search history.

(56) References Cited

U.S. PATENT DOCUMENTS 3,894,381 A * 7/1975 Christine ..... B29C 66/83411 53/410
4,709,528 A * 12/1987 Merkus ..... B29C 66/83221 53/551

(Continued)

FOREIGN PATENT DOCUMENTS

| | | |
|---|---|---|
| DE | 4023274 | 1/1992 |
| EP | 2032451 | 3/2009 |

(Continued)

OTHER PUBLICATIONS

International Search Report, PCT/IB2020/061080, dated Feb. 15, 2021, 2 pages.

*Primary Examiner* — Thomas M Wittenschlaeger
(74) *Attorney, Agent, or Firm* — Fattibene and Fattibene, LLC; Paul A. Fattibene

(57) ABSTRACT

A system and a method for producing packages (100) provided with a reversible closing system (110) comprising a support (111) fixed to the package and a cap (112) reversibly applicable to the support are presented. The packages are formed by means of a forming tube (210), by forming a tubular structure of flexible material (300) wound around the forming tube. The reversible closing system is applied to the film of flexible material so that the support is fixed inside the packages. The application of the reversible closing system is performed when the film is wound around the forming tube.

12 Claims, 9 Drawing Sheets

(56) References Cited

U.S. PATENT DOCUMENTS

| | | | | |
|---|---|---|---|---|
| 4,779,397 | A | 10/1988 | Christine et al. | 53/410 |
| 4,887,912 | A | 12/1989 | Stumpf | 383/66 |
| 4,924,655 | A * | 5/1990 | Posey | B29C 66/8167 493/929 |
| 5,467,581 | A * | 11/1995 | Everette | B65B 61/186 53/550 |
| 2003/0196411 | A1* | 10/2003 | Schroeder | B65B 9/093 53/410 |
| 2004/0083684 | A1* | 5/2004 | Schroeder | B65B 61/186 53/410 |
| 2011/0047939 | A1* | 3/2011 | Griffin | B65B 61/186 53/451 |
| 2018/0237173 | A1 | 8/2018 | Bierschenk | B65B 1/22 |
| 2019/0382148 | A1 | 12/2019 | Rapparini | B65B 31/045 |
| 2021/0094717 | A1 | 4/2021 | Ferrarini et al. | B65B 55/08 |

FOREIGN PATENT DOCUMENTS

| | | |
|---|---|---|
| WO | WO 2007/132021 | 11/2007 |
| WO | WO 2012/004312 | 1/2012 |
| WO | WO 2013/107539 | 7/2013 |
| WO | WO 2018/100563 | 6/2018 |
| WO | WO 2019/192898 | 10/2019 |

* cited by examiner

SYSTEM AND METHOD FOR PRODUCING PACKAGES PROVIDED WITH A REVERSIBLE CLOSING SYSTEM

TECHNICAL FIELD

The present invention refers to the field of packages provided with a reversible closing system. In particular, the present invention relates to the field of packages of flexible material provided with a reversible closing system, for example a cap that can be screwed onto a support fixed to the packages and that can be thus unscrewed.

STATE OF THE ART

Packages of flexible material are widely used to pack different types of products, for example food products. These packages can be obtained from a film of flexible material unwound from a reel and wrapped around a forming tube. Documents describing the formation of packages of flexible material by means of a forming tube are for example WO 2018/100563 A1, WO 2019/192898 A1 and US 2018/0237173 A1.

These packages can be advantageously provided with a reversible closing system. In particular, these packages are generally sealed by welding. If they are not provided with a reversible closing system, when they are opened to extract the product packed inside them, this seal has to be irreversibly damaged and it is then difficult to appropriately reclose the packages in order to protect the remaining product inside the packaging. Reversible closing systems, for example caps that can be screwed and unscrewed onto supports fixed to the packages, allow the packages to be opened and closed in an appropriate and reversible manner.

Examples of these packages provided with reversible closing systems of this type can be found in WO 2013/107539 A1, WO 2007/132021 A1, U.S. Pat. No. 4,887,912, WO 2012/004312 A1, DE 40 23 274 A1, EP 2 032 451 A1 and U.S. Pat. No. 652,673.

In some cases, as for example in U.S. Pat. No. 652,673, the reversible closing system is applied to the outside of the package. These systems have the disadvantage that the reversible closing system can be accidentally detached from the package. Furthermore, special packaging materials that are difficult to grind, such as double-sealing films, or in the absence of these, complex and expensive techniques, such as ultrasonic welding, may be required to fix the reversible closing system to the outside of the package.

Solutions have therefore been suggested as in U.S. Pat. No. 4,887,912, wherein the support of the reversible closing system is fixed to the inner surface of the package and the reversible closing system projects through a hole in the film of flexible material.

Even if these solutions allow overcoming the problems of the packages with the reversible closing system fixed to the outside, the formation of these packages is complex. The reversible closing system is fixed to the film of flexible material before forming the package, that is when the film is still stretched after being unwound from the reel. However, the subsequent handling of the film provided with the reversible closing systems to form the packages is critical since the reversible closing systems fixed to the film can easily block or complicate the subsequent steps that need to be performed on the film to obtain the packages.

The object of the present invention is to overcome the problems of the state of the art.

SUMMARY OF THE INVENTION

According to the present invention, the reversible closing system is applied to the film of flexible material employed to form the packages, in particular on the surface of the film that will be used to form the internal surface of the package, when the film of flexible material is wrapped around the forming tube and hence forms the tubular structure from which the filled and sealed packages will be cut. In this way, the reversible closing system is applied after that the film has been wrapped around the tubular system, thus avoiding the problems of the state of the art of handling the film provided with reversible closing systems.

According to an embodiment of the present invention, a method for producing packages provided with a reversible closing system comprising a support fixed to the package and a cap applicable in a reversible manner to said support is provided, wherein said method comprises the following steps:

- formation of the packages by means of a forming tube, wherein said packages are formed from a film of flexible material that is wrapped around said forming tube;
- formation of a hole in the film of flexible material in correspondence to the position where the reversible closing system is applied to the package;
- application of said support to said film of flexible material so that said support is fixed to the inner side of the packages, the application being carried out when the film is wrapped around the forming tube;

wherein the hole is formed in the film of flexible material before wrapping the film around the forming tube.

This configuration is particularly advantageous because it allows the holes to be made in preferred positions of the film of flexible material and therefore to position the supports at preferred heights of the package, without having to resort to predefined positions depending on the configuration of the cutting means. In addition, it is possible to create large packages without having to resort to huge machines, because the height of the package is independent of the height of the machine. Furthermore, by making the holes upstream of the forming tube, there is no risk that the slugs of the film of flexible material fall into the package, contaminating the product contained therein.

The formation of the packages by means of a forming tube from a film of flexible material wrapped around the forming tube can be done in several ways, known to the skilled person. For example, documents describing the formation of packages of flexible material by means of a forming tube are WO 2018/100563 A1, WO 2019/192898 A1 and US 2018/0237173 A1. The film of flexible material is generally unwound from the reel and wrapped around the forming tube. The film is then sealed to form a tubular structure, which is made to slide along the forming tube. The tubular structure is welded at the bottom of the forming tube so as to form the bottom of the package. The product to be filled in the package is supplied in the tubular structure through the forming tube. The film is then sealed so as to close the filled package. Finally, the filled and closed package is cut from the tubular structure.

The support is applied to the film of flexible material so that it is fixed inside the packages. In particular, the fixing between the support and the film of flexible material occurs through the surface of the film of flexible material, which is inside the package. The surface inside the package is normally sealable, as it is necessary for closing the bag, for example heat sealable. In this way, the application of the support to the film can be done in a simple and effective way. Furthermore, by fixing the support inside the package, the probability that the reversible closing system is accidentally detached from the package is minimized.

According to the present invention, the support of the reversible closing system is applied to the film of flexible material when the film is wrapped around the forming tube. Basically, the support is applied to the tubular structure formed with the film of flexible material around the forming tube. This allows to solve the problems of the state of the art. In particular, the subsequent manufacturing steps of the package are simplified, because the closing system is applied to the tubular structure already formed around the forming tube. Therefore, there are no problems that arise when forming the tubular with a film of flexible material already provided with reversible closing systems. The folding of such a film around the tubular structure is complex, because the reversible closing systems can be blocked or, in any case, interact when the film is wrapped around the tubular structure.

According to the present invention, the application of the support to the film of flexible material can occur when the support and the cap are assembled to form the reversible closing system. In other words, according to this configuration, it is not only the support that is applied to the film of flexible material, but it is the assembled reversible closing system that is directly applied to the film of flexible material by applying the support. Alternatively, the assembly of the reversible closing system can take place after the support has been fixed to the film of flexible material, that is the cap is applied to the support only after the support has been fixed to the film of reversible material.

According to a further embodiment of the present invention, a method is provided, wherein said application is carried out by means of welding and wherein said welding is carried out by means of a welder that operates on the surface of said film of flexible material forming the outer side of the packages. Welding can be carried out, for instance, with heated bars, ultrasounds or by induction.

According to a further embodiment of the present invention, a method is provided, wherein said support is applied to said film by fixing it along a surface around said hole and facing toward the inner side of the package.

The hole is advantageously formed in the film of flexible material before wrapping the film around the forming tube. For example, the hole can be formed when the film is stretched, after unwinding it from the reel and before wrapping it around the forming tube. In this way, a tubular structure is formed around the forming tube, which has different holes in the positions in which the reversible closing systems will be applied to the various packages obtained from the tubular structure.

According to a further embodiment of the present invention, a method is provided, wherein said forming tube comprises a hole configured for the transfer of said support and wherein said method comprises the following steps:

- providing said support inside said forming tube;
- aligning said hole of said film of flexible material with said hole of said forming tube;
- extracting of said support from the inside of said forming tube through said hole of said forming tube, so that at least a portion of said support overpasses also said hole of said film of flexible material and at least a portion of said support remains inside said hole of said film of flexible material.

According to a further embodiment of the present invention, a method is provided, wherein said hole of said forming tube has a larger diameter than the diameter of said hole of said film of flexible material. This advantageously allows automatically stopping the expulsion of the reversible closing system, in such a way that it does not come out from the hole of the film.

According to a further embodiment of the present invention, a method is provided, further comprising the following step:

- providing a product to be filled in the packages within the forming tube, in such a way that the product, by falling through the forming tube, is in contact with a track wherein the support is conveyed.

This configuration allows exploiting a single forming tube for providing the product to be filled in the packages and the supports to be fixed to the packages.

According to a further embodiment of the present invention, a system for producing packages provided with a reversible closing system comprising a support fixed to the package and a cap applicable in a reversible manner to said support is provided, said system comprising:

- a forming tube for forming packages from a film of flexible material that is wrapped around said forming tube;
- holes forming means configured to form a hole in the film of flexible material in correspondence to the position where the support is applied;
- application means for applying said support to said film of flexible material, so that said support is fixed to the inner side of the packages, said application means being configured so as to apply the support to the film, when the film is wrapped around the forming tube;
- wherein the holes forming means are placed upstream of the forming tube so that the holes are formed in the film of flexible material while it is unwound, before wrapping it around the forming tube.

This configuration is particularly advantageous because it allows the holes to be made in preferred positions of the film of flexible material and therefore to position the supports at preferred heights of the package, without having to resort to predefined positions depending on the configuration of the cutting means. Furthermore, it is possible to create large packages without having to resort to huge machines, because the height of the package is independent of the height of the machine. Furthermore, by making the holes upstream of the forming tube, there is no risk that the slugs of the film of flexible material fall into the package, contaminating the product contained therein.

DETAILED DESCRIPTION OF THE INVENTION

Figure 1:
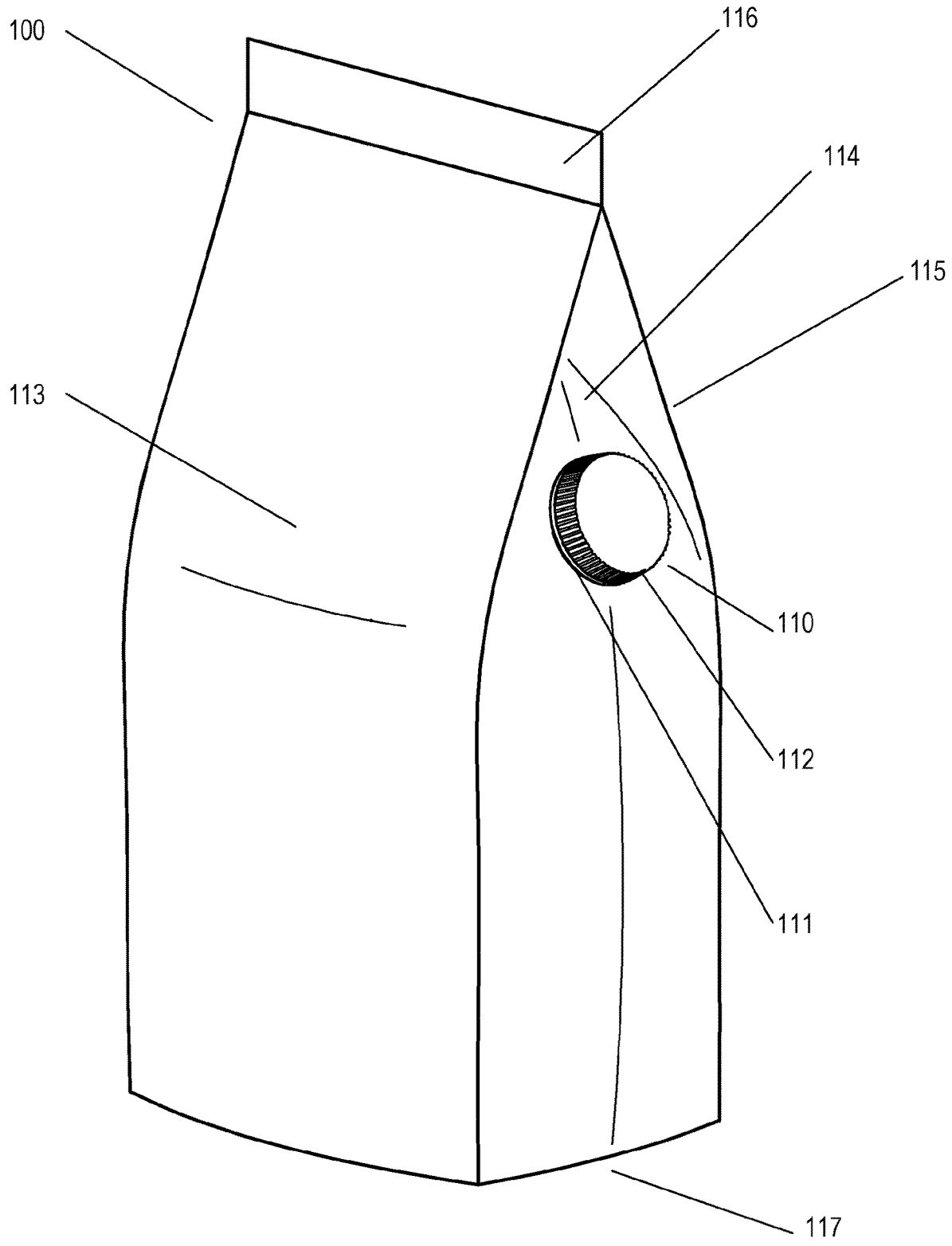
FIG. 1 schematically illustrates a package.
Figure 2:
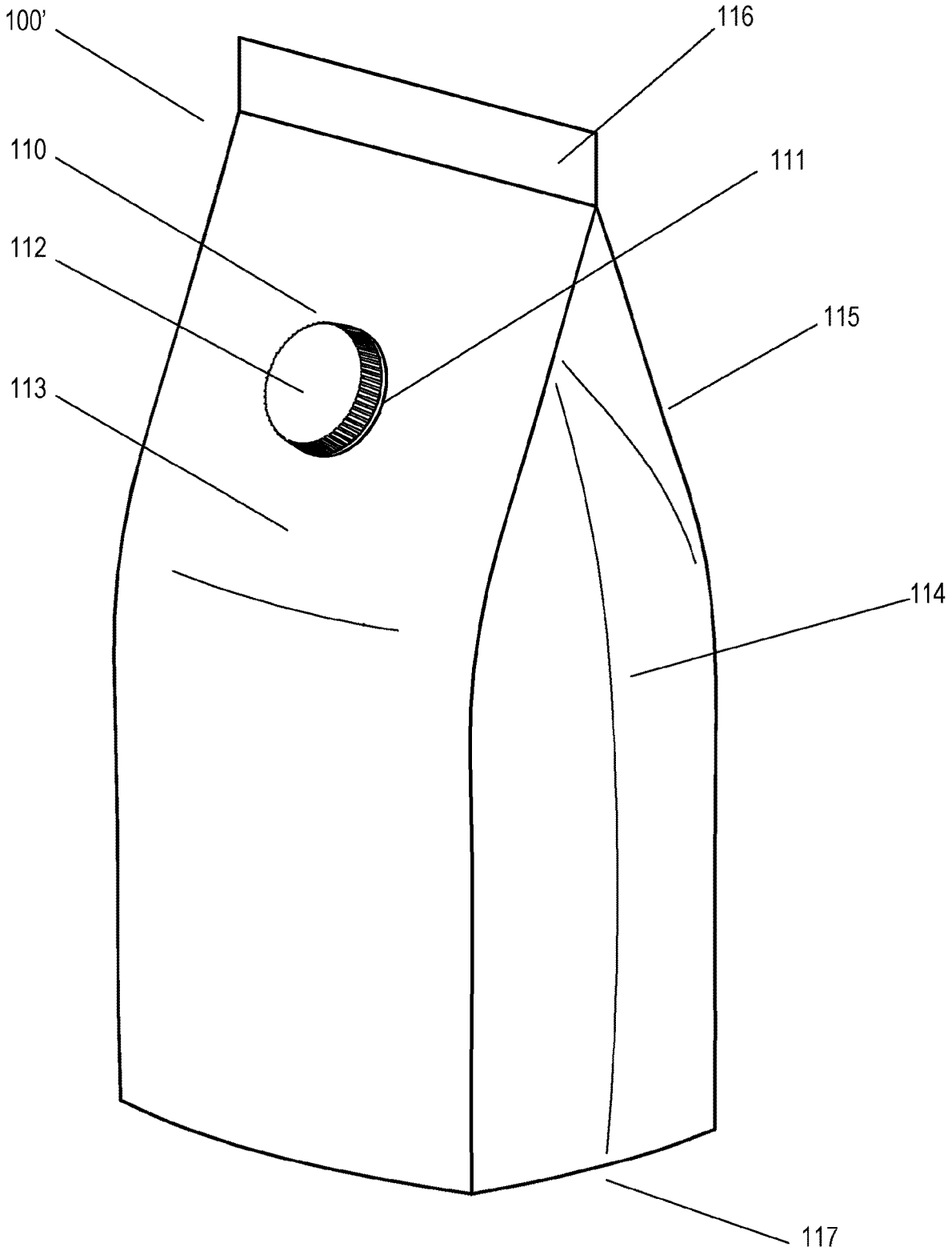
FIG. 2 schematically illustrates another package.

Packages like the packages 100, 100' shown in FIGS. 1 and 2 may be used for packaging different kinds of products, for instance, food products, such as coffee, flour, sugar or the like. Packages 100, 100' comprise sides 113, 114, 115, sealed top 116, and sealed bottom 117. A reversable closing system 110 is held in one side.

Figure 3A:
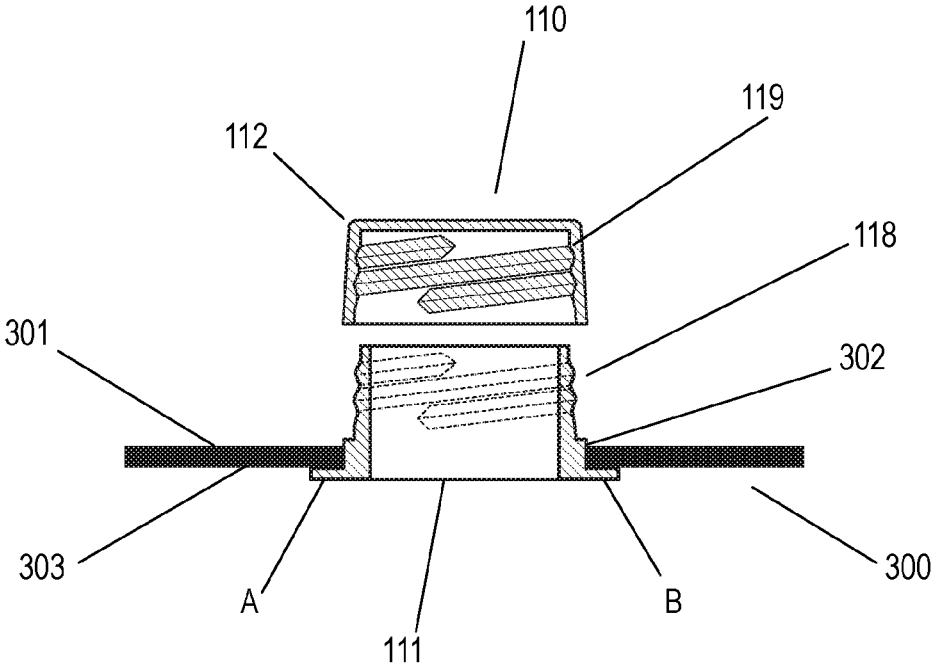
FIGS. 3A-B is a sectional view schematically illustrating a reversable closing system.
Figure 3B:
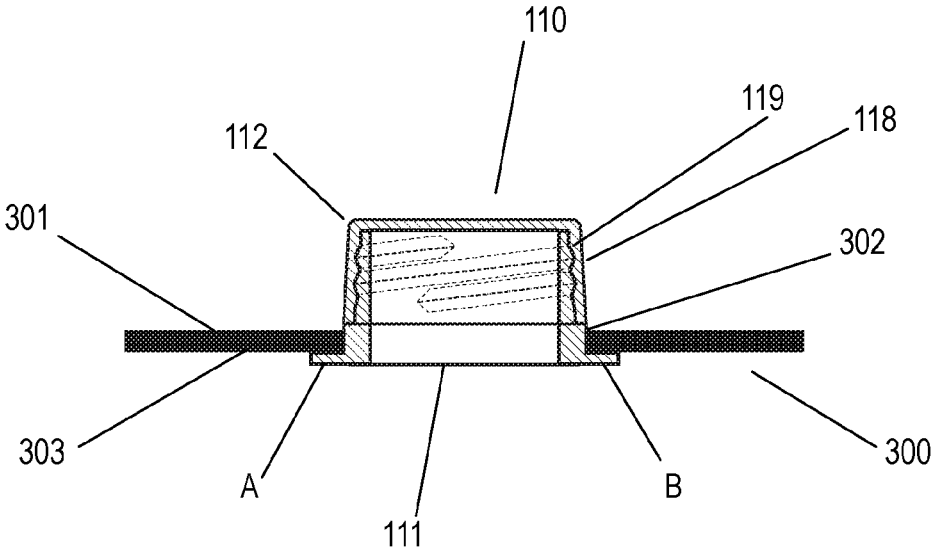

FIGS. 3A-B schematically show a sectional view of a detail of the packages of FIGS. 1 and 2. FIGS. 3A-B show, in particular, a portion of the film 300 of flexible material by which the package 100 is made. The film 300 comprises a surface 301 external to the package and a surface 303 internal to the package. Basically, in the configuration of the figure, the inside of the package faces downwards and the external of the package faces upwards. The film 300 comprises a hole 302 in correspondence to which the reversible closing system is fixed. The figure shows that the support 111 is fixed to the surface 303 of the film 300 inside the package. In other words, the support 111 is fixed to the inside of the package. The support 111 comprises a flange that can be used to fix it to the internal surface of the package. The fixing of the support 111 to the internal surface 303 through the flange may occur in the areas A and B inside the package through welding.

The figure further shows that the support 111 protrudes through the hole 302 in such a way that a portion of the support 111 results on the outside of the package. The portion on the support 111 protruding towards the external part of the package is used to be coupled with the cap 112. For instance, in the example shown in the figure, the portion 111 of the support protruding towards the external part of the package comprises the threaded portion 118 that can be coupled with the threaded portion 119 of the cap 112.

In the following, with reference to FIGS. 4 to 9, a method and a system for producing packages like the ones shown in FIGS. 1 and 2 are described.

The system comprises a forming tube 210. The formation of packages of flexible material by means of a forming tube is known to the skilled person and is, hence, not described in detail. Examples of documents that describe the formation of packages of flexible material by means of a forming tube are WO 2018/100563 A1, WO 2019/192898 A1 and US 2018/0237173 A1. A film of flexible material is wrapped around the forming tube and, hence, the needed welding and cutting operations are carried out in such a way as to form the packages. The forming tube is advantageously employed to fill the packages during this formation.

Figure 4:
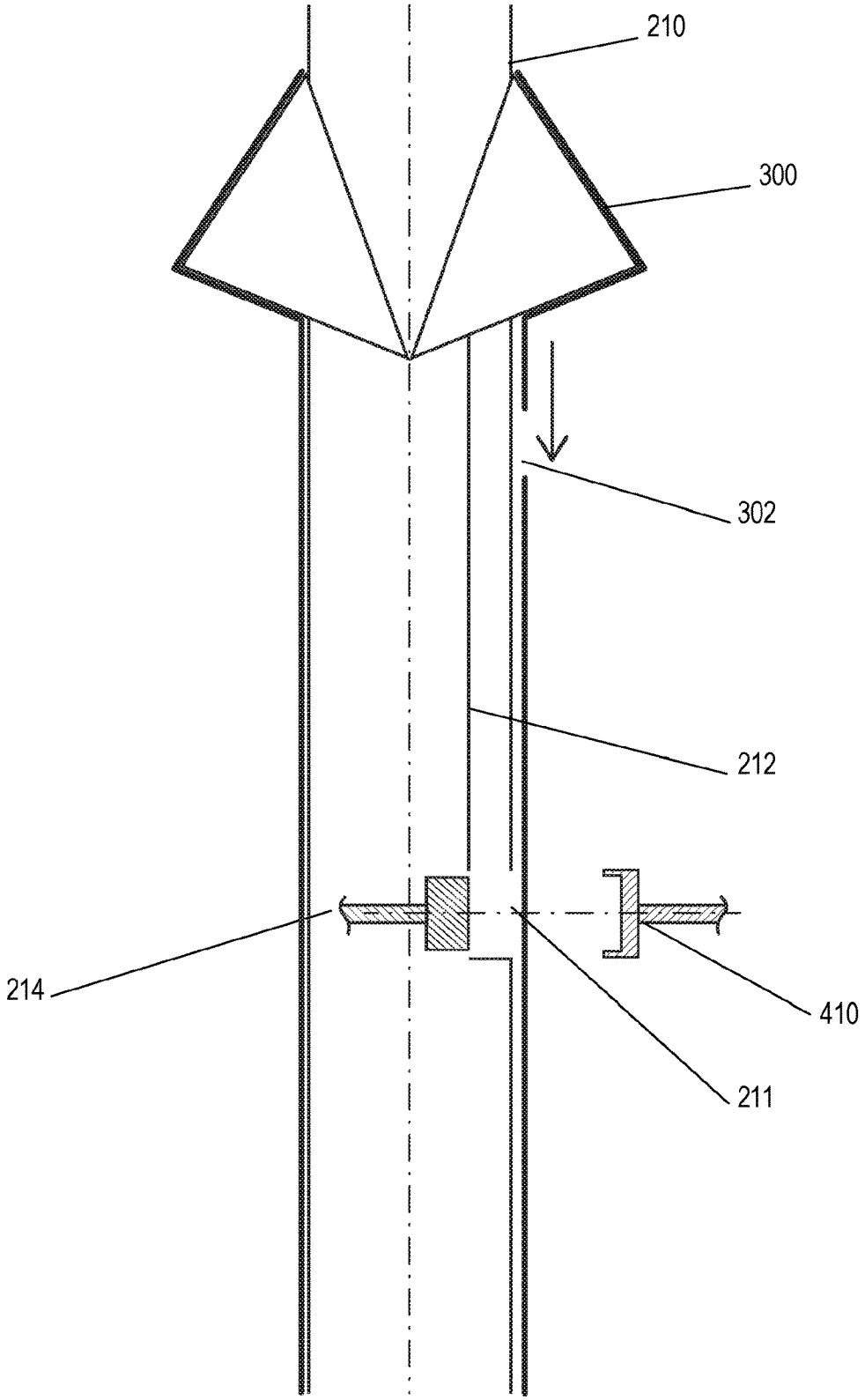
FIGS. 4-9 schematically illustrates method steps and a system for producing packages.

FIG. 4 shows that the film of flexible material 300 is wrapped around the forming tube 210. The formation of the packages occurs by making the film 300 sliding along the forming tube towards the bottom. The figure shows that the forming tube accommodates a track 212 that ends in correspondence to the hole 211 of the forming tube. The forming tube 210 is configured so as to contain the track 212 and in such a way that the product to be filled in the packages falls through the forming tube in the region 215 adjacent to the track 211, where the area comprises, for instance, the element 214 that acts as a holder for the application of the support 111. Preferably, the product to be filled in the packages, during its falling through the forming tube 210, is in contact with the track 212.

The figure further shows that in this step, the film 300 comprises a hole 302 placed in the upper part of the forming tube.

Figure 5:
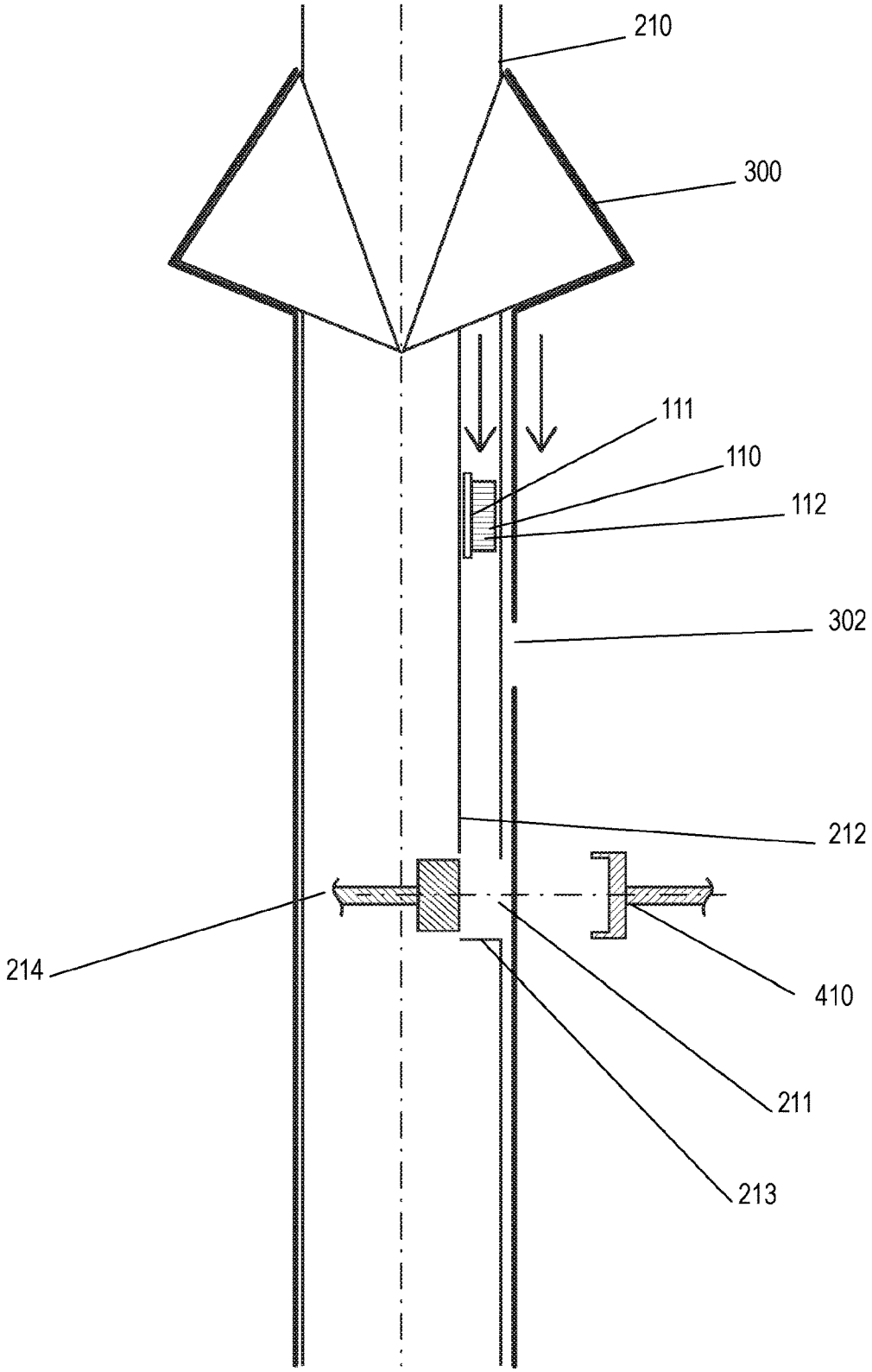

FIG. 5 further shows a following step. A reversible closing system 110 is made to slide along the track 212 inside the forming tube 210. For instance, the reversible closing system 110 may fall by freefall along the track 212. The reversible closing system 110 may be provided in the track 212 from a feeding reservoir of reversible closing system 110. The reversible closing systems 110 may be oriented in a suitable way before being fed to the track 212. The track 212 may be configured in such a way that during falling of the reversible closing systems 110 along the track itself, their orientation does not change. In particular, in the configuration shown in FIG. 5, the support 111 faces leftwards, while the cap 112 faces rightwards. The size of the track 212 is such that orientation cannot change during falling of the reversible closing system 110.

In the steps shown in FIG. 5, it can be also seen that the film 300 has been slid towards the bottom. The hole 302 is, in fact, in a lower position with respect to the step shown in FIG. 4.

Figure 6:
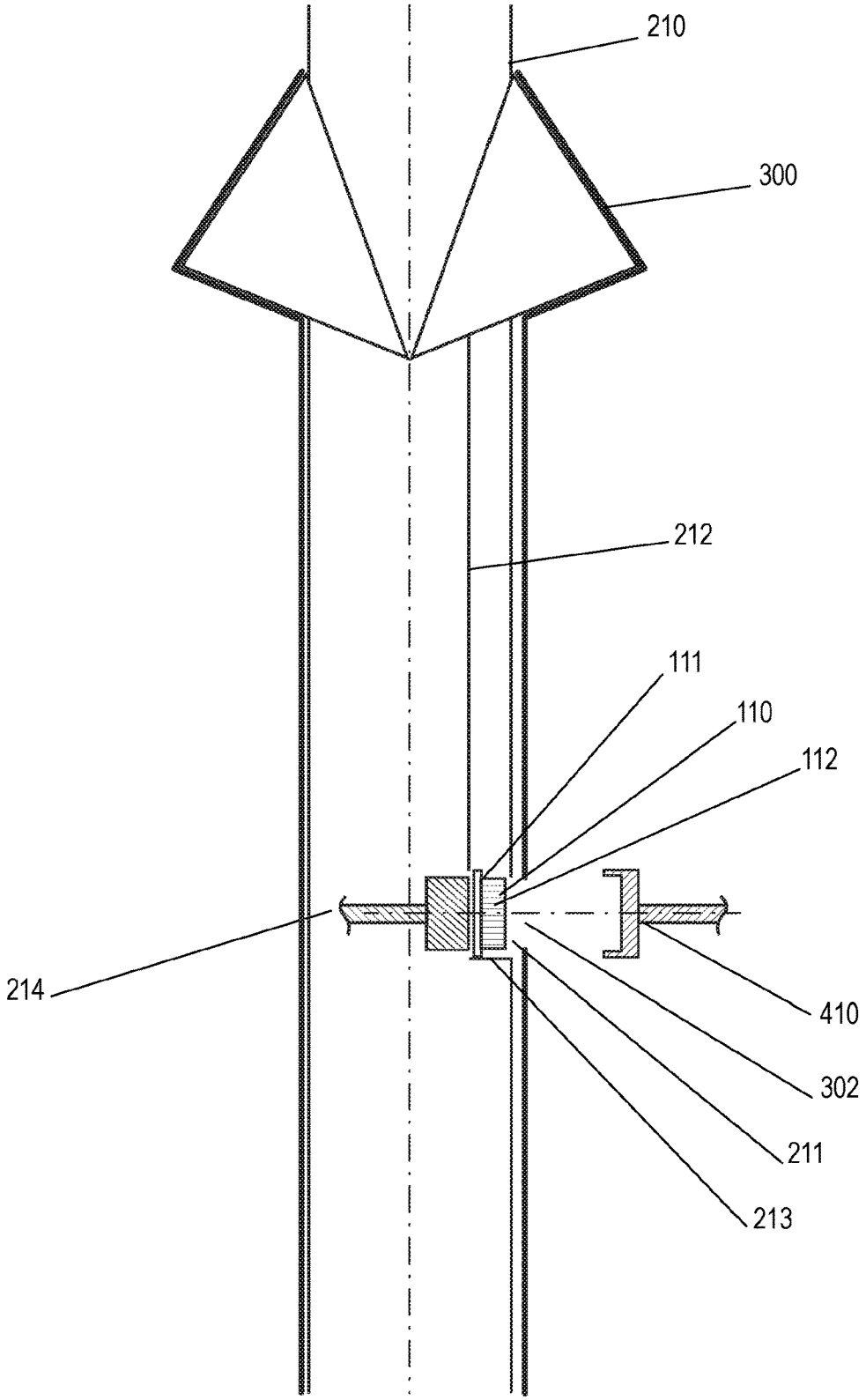

FIG. 6 shows a following step. The track 212 inside the forming tube 210 comprises a terminal portion 213 in correspondence to the hole 211 of the forming tube 210. The terminal portion 213 is configured to stop the sliding of the reversible closing system 111 along the track 212. In particular, the sliding of the reversible closing system 110 is stopped through the terminal portion 213, when the reversible closing system 110 is in correspondence to the hole 211 of the forming tube 210.

In the step of FIG. 6, the film 300 has been further slid towards the bottom and stopped in the moment in which the hole 302 of the film 300 is aligned with the hole 211 of the forming tube 210. Blocking in this position can be regulated in different ways, for instance, by means of detection systems that detect when the holes 302 and 211 are aligned and with a control system that blocks the sliding towards the bottom of the film 300 when this situation has been detected.

Figure 7:
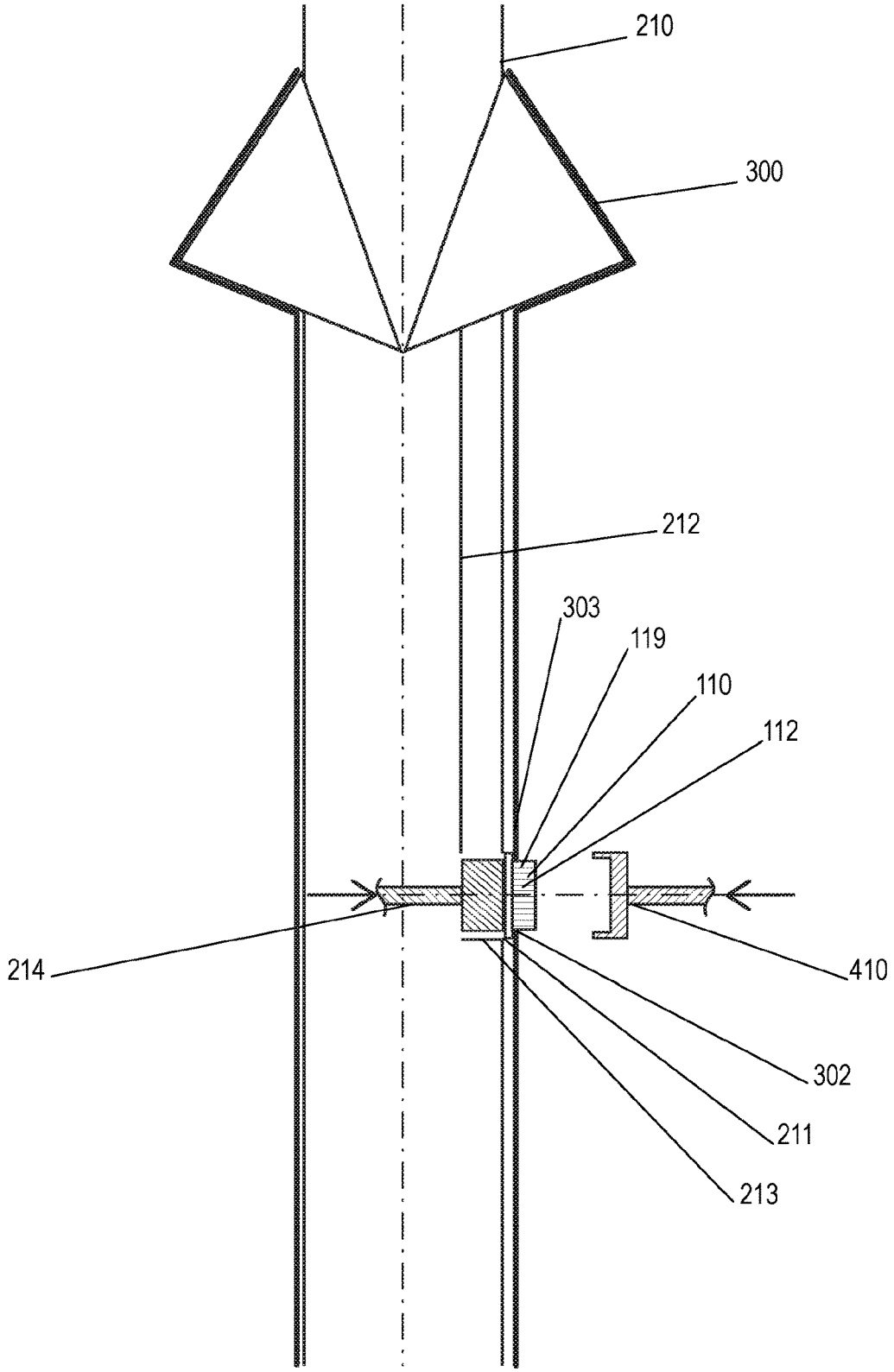
Figure 8:
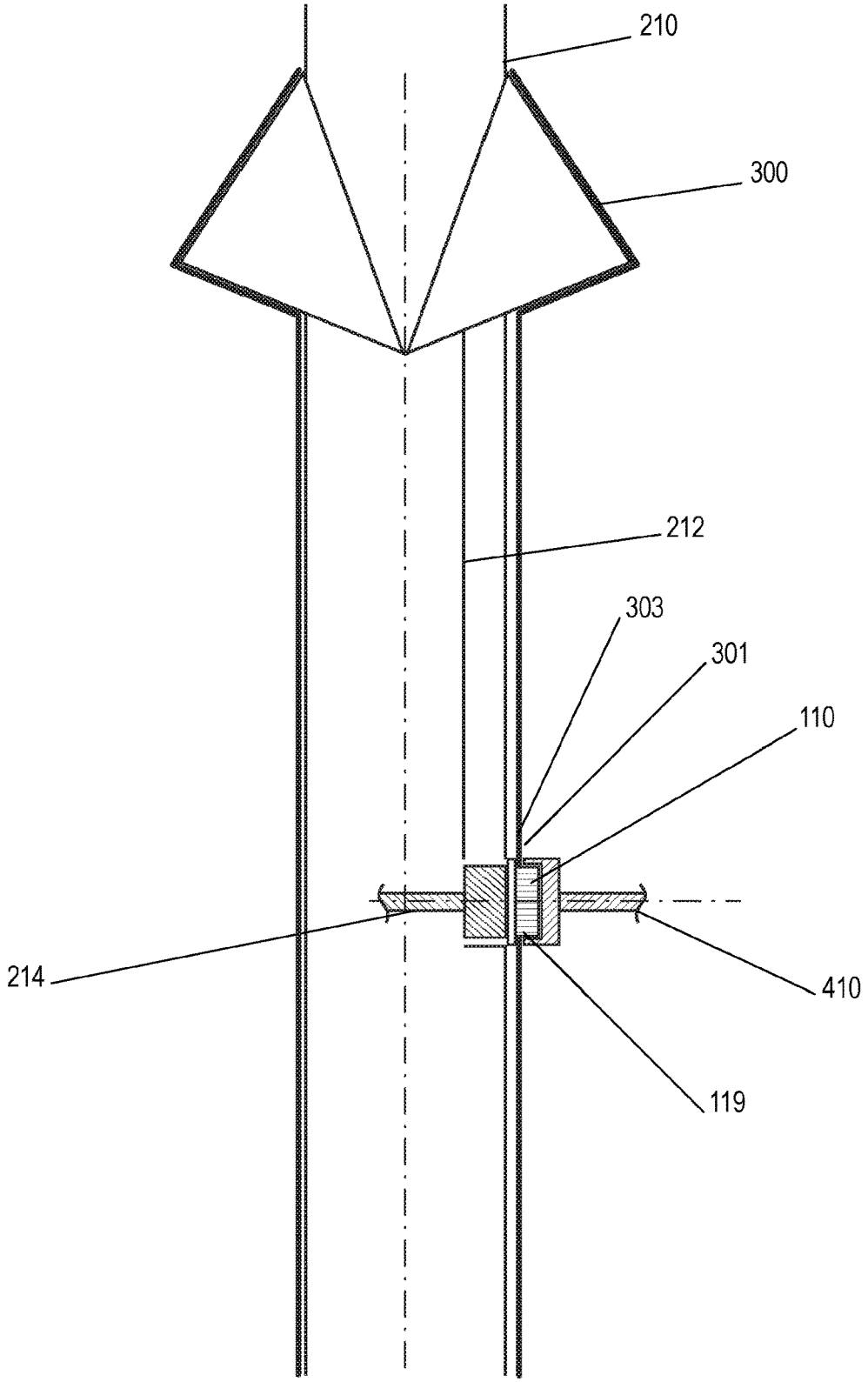
Figure 9:
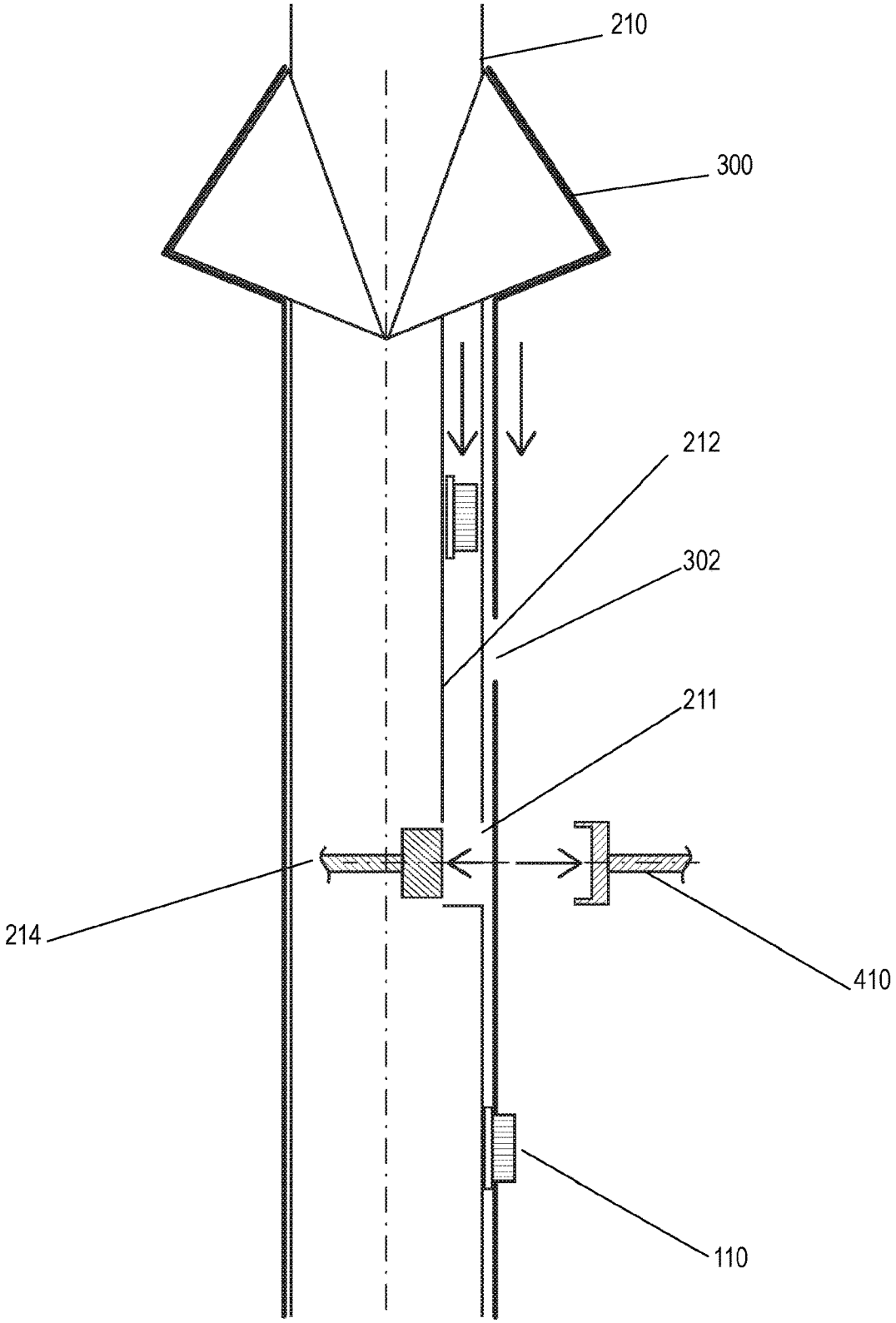

FIG. 7 shows a following step. The reversible closing system 110 is extracted from the inside of the forming tube 210 and is driven towards the outside of the forming tube 210 through the hole 211 of the forming tube 210. This operation can be carried out by means of grabbing means 410. For instance, this operation can be carried out by pushing the reversible closing system 110 from the inside of the forming tube 210 towards the outside. In an alternative way, this operation can be [be] alternatively carried out only with the support and the cap could be later fixed, for instance screwed, to the support previously fixed to the packages.

Finally, those fields which are considered known to the skilled person have not been described, in order to avoid obscuring in a useless way the described invention.

For instance, the steps, known to the skilled person, for forming packages with a film of flexible material by means of a forming tube have not been described in detail, for instance, the unwinding of the film from a reel, the wrapping of the film around a forming tube, the welding of the film to form the bottom of the packages, the filling of the packages, the welding of the film to close the packages and the cutting of the packages thus formed from the film and filled.

As a consequence, the invention is not limited to the embodiments described above, but it is only limited to the scope of protection of the enclosed claims.

What is claimed is:

1. Method for producing packages provided with a reversible closing system comprising a support fixed to the package and a cap applicable in a reversible manner to said support, said method comprising the following steps:

formation of the packages by a forming tube, wherein said packages are formed from a film of flexible material that is wrapped around said forming tube;

formation of a hole in said film of flexible material in correspondence to the position where said reversible closing system is applied to the package;

application of said support to said film of flexible material so that said support is fixed to the inner side of said packages, said application being carried out when said film is wrapped around said forming tube;

wherein, said hole is formed in said film of flexible material before wrapping said film around said forming tube; and providing a product to be filled in said packages within said forming tube, in such a way that said product, by falling through said forming tube, is in contact with a track along which said support is conveyed.

2. Method according to claim 1, wherein said application is carried out by welding and wherein said welding is carried out by a welder that operates on the surface of said film of flexible material forming an outer side of said packages.

3. Method according to claim 1, wherein said support is applied to said film by fixing it along a surface around said hole facing toward an inner side of said package.

4. Method according to claim 1, wherein said forming tube comprises a hole configured for the transfer of said support and wherein said method comprises the following steps:

providing said support inside said forming tube;

aligning said hole of said film of flexible material with said hole of said forming tube;

extracting said support from the inside of said forming tube through said hole of said forming tube so that at least a portion of said support overpasses also said hole of said film of flexible material and at least a portion of said support remains inside said hole of said film of flexible material.

5. Method according to claim 4, wherein said hole of said forming tube has a larger diameter than the diameter of said hole of said film of flexible material.

6. System for producing packages provided with a reversible closing system comprising a support fixed to the package and a cap applicable in a reversible manner to said support, said system comprising:

a forming tube for forming packages from a film of flexible material that is wrapped around said forming tube;

holes forming means configured to form a hole in said film of flexible material in correspondence to the position where said support is applied;

application means for applying said support to said film of flexible material so that said support is fixed to the inner side of said packages, said application means being configured so as to apply said support to said film of flexible material when said film is wrapped around said forming tube;

wherein, said holes forming means are placed upstream of said forming tube so that said holes are formed in said film of flexible material while it is unwound, before wrapping it around said forming tube, and wherein said forming tube comprises a track along which said support can be conveyed and wherein said system is configured in such a way that a product to be filed filled in said packages, by falling through said forming tube, is in contact with said track.

7. System according to claim 6, wherein said application means comprise at least a welder configured to operate on the surface of said film of flexible material forming an outer side of said packages.

8. System according to claim 6, wherein said forming tube comprises a hole configured for the transfer of said support from an inside of said forming tube to an outside of said forming tube.

9. System according to claim 8, wherein said track guides said support from a feeding reservoir to said hole of said forming tube.

10. System according to claim 8, wherein said application means comprise extraction means for extracting said support from the inside of said forming tube to the outside of said forming tube through said hole of said forming tube.

11. System according to claim 8, further comprising means for aligning said hole formed in said film of flexible material with said hole of said forming tube.

12. System according to claim 6, wherein:

said track is contained within said forming tube, said track having a wall dividing inside said forming tube into a fill tube portion and said track wherein the wall is common to the fill tube portion and said track, whereby the product falls through the fill tube portion of said forming tube with the product in contact with the wall common to the fill tube portion and said track before filling the packages.

* * * * *